US005715607A

United States Patent [19]

Murg

[11] Patent Number: 5,715,607

[45] Date of Patent: Feb. 10, 1998

[54] TELESCOPIC SIGHT

[75] Inventor: Erwin Murg, Rum b. Innsbruck, Austria

[73] Assignee: Swarovski Optik KG, Absam, Austria

[21] Appl. No.: 716,330

[22] PCT Filed: Feb. 13, 1996

[86] PCT No.: PCT/EP96/00609

§ 371 Date: Oct. 4, 1996

§ 102(e) Date: Oct. 4, 1996

[87] PCT Pub. No.: WO96/25640

PCT Pub. Date: Aug. 22, 1996

[30] Foreign Application Priority Data

Feb. 14, 1995 [DE] Germany ..... 195 04 898.9

[51] Int. Cl.[6] ..... F41G 1/32

[52] U.S. Cl. ..... 33/241; 33/246; 33/334

[58] Field of Search ..... 33/241, 233, 245, 33/246, 247, 248, 334; 42/101, 103; 362/110

[56] References Cited

U.S. PATENT DOCUMENTS

| | | | |
|---|---|---|---|
| 1,931,552 | 10/1933 | Maris | 33/241 |
| 2,625,764 | 1/1953 | O'Brien et al. | 42/103 |
| 2,909,838 | 10/1959 | Kollmorgen et al. | 33/50 |
| 3,994,072 | 11/1976 | Agnello, Jr. | 33/241 |
| 4,524,534 | 6/1985 | Kaye et al. | 42/103 |
| 4,859,058 | 8/1989 | Ekstrand | 33/241 |
| 5,065,520 | 11/1991 | Shimzu et al. | 33/241 |
| 5,274,928 | 1/1994 | Arnt | 33/334 |
| 5,323,555 | 6/1994 | Jehn | 42/103 |
| 5,493,450 | 2/1996 | Ekstrand | 33/233 |
| 5,508,843 | 4/1996 | Tomita | 33/241 |
| 5,513,440 | 5/1996 | Murg . | |

FOREIGN PATENT DOCUMENTS

| | | | |
|---|---|---|---|
| A O 595 315 | 5/1994 | European Pat. Off. . | |
| A 35 01 321 | 8/1985 | Germany . | |
| 249 546 | 9/1987 | Germany . | |
| 43 41 151.7 | 6/1995 | Germany | F41G 1/38 |

*Primary Examiner*—Daniel G. DePumpo
*Attorney, Agent, or Firm*—Fish & Richardson P.C.

[57] ABSTRACT

A telescopic sight has a light source on the inner tube in the area of the graticule.

18 Claims, 2 Drawing Sheets

TELESCOPIC SIGHT

This is a International application PCT/96EP/00609, with an International Filing Date of Feb. 13, 1996.

This invention relates to a telescopic sight having adjusting spindles disposed at an angle to each other, engaging in a thread on the main tube and acting upon an inner tube having the graticule and being movably mounted within the main tube, and a light source disposed on the inner tube in the area of the graticule and adapted to be connected to a current source for illuminating the graticule.

Such a telescopic sight is known (U.S. Pat. No. 2,909,838). The graticule is formed by cross hairs comprising two electrically heatable wires which can be made to glow. The cross hairs are fastened for this purpose to a sheath which is electrically insulated by insulating material from the inner tube. The sheath comprises two halves electrically insulated from each other and connected to a battery by lines not shown in detail. Since the wires expand when heated, they must be tensed with springs. Although the thin wires are made of a platinum-iridium alloy, they are exposed to fast oxidation at the high glowing temperature.

According to DD 249 546 A1 a radioactive illuminant is used for the illuminating device of a telescopic sight. Radioactive illuminants are inadmissible for civil applications. Furthermore their brightness is too low for illuminating the graticule properly.

According to EP 0 595 315 A1 a light source is provided in a sheath-shaped adjusting spindle of the telescopic sight, its light falling through a bore onto an optical fiber forming the sighting point of the graticule. This known illuminable telescopic sight has proven useful on the whole. A disadvantage, however, is that the graticule must be disposed at the same level axially as the threaded spindle. The brightness of the illumination also leaves something to be desired, especially since the sighting point and not the crossbars of the graticule are illuminated.

The problem of the invention is therefore to provide a telescopic sight having a well illuminated graticule and a simple current supply from outside without any need to make any essential changes in the telescopic sight.

This is obtained according to the invention with the telescopic sight characterized in the claims. The subclaims state advantageous embodiments of the invention.

According to the invention the light source is fastened to the inner tube in the area of the graticule. This causes the graticule to be brightly illuminated. It further permits the graticule to be disposed at any place in the longitudinal direction of the telescopic sight. Current is supplied to the light source via one of the two adjusting spindles used for adjusting the graticule. The adjusting spindle in question preferably has for this purpose an inside part and a ring part disposed around the inside part and electrically insulated from the inside part, the thread with which the adjusting spindle engages in the thread on the main tube being fastened to the ring part. The inside part connects the light source with one pole of the current source, and the ring part with the other pole thereof.

The inside part and the ring part of the adjusting spindle are preferably connected to the light source on the inner tube for one pole of the light source by a line disposed on the inner tube and having a contact piece acted upon by the inside part of the adjusting spindle. In contrast, the ring part of the adjusting spindle is connected by a flexible line, for example by plate and/or spiral springs, with the other pole of the light source, which is preferably formed by a light-emitting diode.

The current source, generally a battery, is preferably housed together with a potentiometer in a detachable fixture on the telescopic sight. The fixture can for example be screwed onto the thread used for screwing on the protective cap for the adjusting spindle. The fixture is for this purpose preferably connected with the inside part or the ring part of the adjusting spindle via contact springs.

The fixture can be carried by the user, to be used only when required, for example in poor light or at twilight. In normal light the user can carry it with him.

The illuminating means can be installed on a normal telescopic sight without great effort. One need essentially only replace an adjusting spindle, mount the light source on the inner tube, provide the fixture with the current source, and perform the contacting of the inside part and the ring part of the adjusting spindle with the current source, on the one hand, and with the light source, on the other hand.

In the following an embodiment of the inventive telescopic sight will be explained more closely with reference to the drawing, in which.

Figure 1:
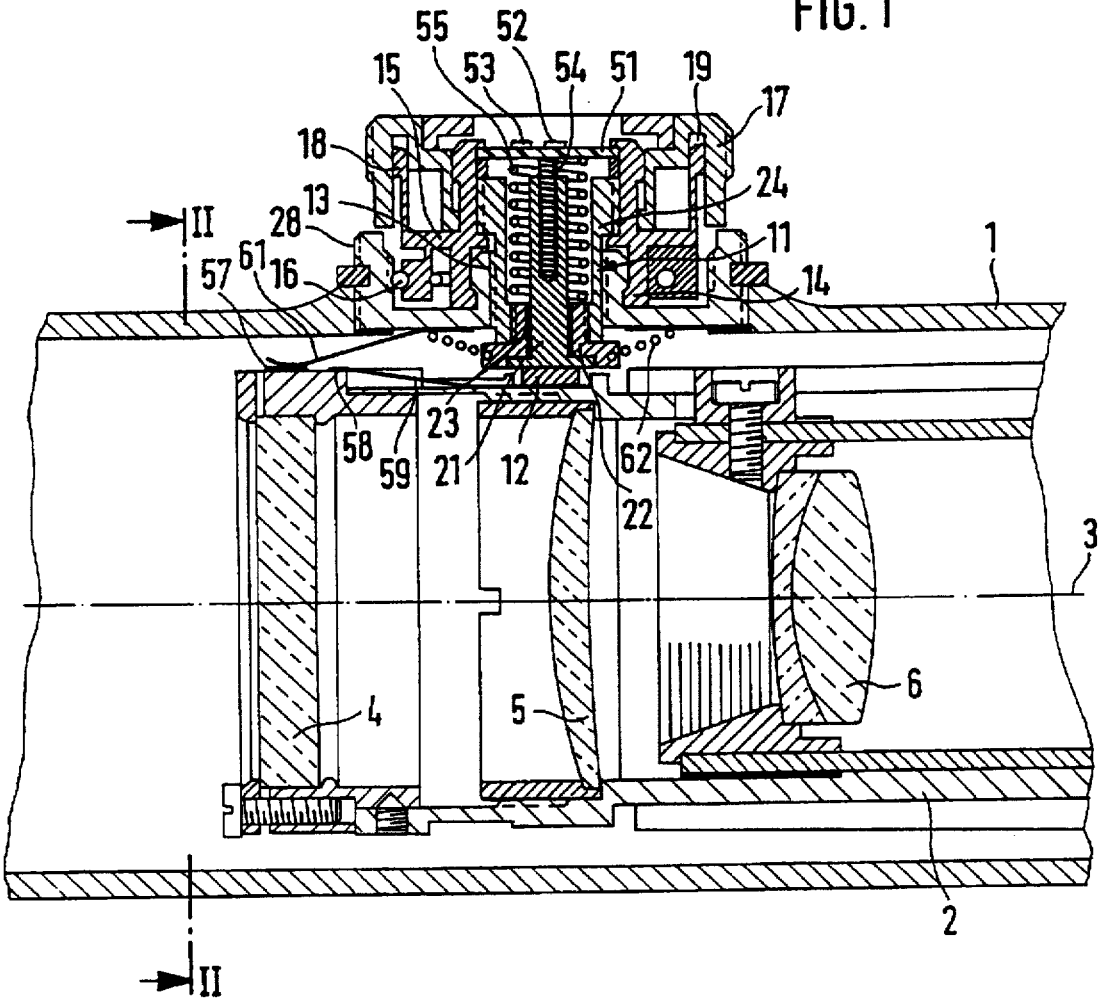
FIG. 1 shows a longitudinal section through a telescopic sight in the area of the adjusting spindles.

According to FIG. 1 inner tube 2 is mounted movably perpendicular to longitudinal tube axis 3 within main tube 1 of a telescopic sight, for example by a ball-and-socket joint (not shown) between the eyepiece end of inner tube 2 and main tube 1.

Disposed at the objective end of the telescopic sight on inner tube 2, which is composed of a plurality of rings, is the reticle or graticule 4, and therebefore the erecting system with lenses 5, 6.

Figure 2:
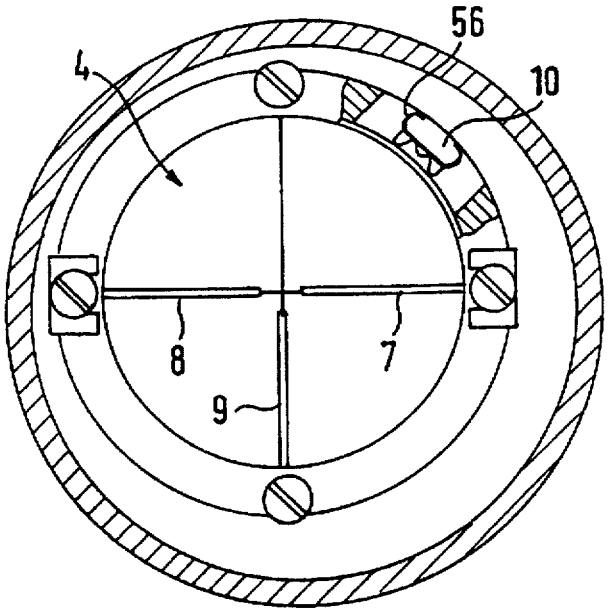
FIG. 2 shows a section along line II—II in FIG. 1, with a part of the inner tube broken off.

Graticule 4 consists according to FIG. 2 of a glass plate with two crossbars 7, 8 and vertical bar 9 perpendicular thereto. On the side of graticule 4 facing away from vertical bar 9, i.e. the upper side thereof, light source 10 in the form of a light-emitting diode is mounted at an angle of for example 45°, being aligned with the center of graticule 4. Graticule 4 can thus be illuminated with high brightness.

Adjusting spindle 11 is mounted on main tube 1 substantially according to German patent application p 43 41 151. 7 (corresponding to U.S. Pat. No. 5,513,440).

That is to say, intermediate housing 13 is fastened in a bore in main tube 1 and has an inside thread into which adjusting spindle 11 is screwed. Adjusting spindle 11 is connected with hub 14 so as to rotate therewith by a groove toothing provided on the axially outer portion of hub 14. The axially inner portion of hub 14, however, is mounted rotatably but axially undisplaceably on intermediate housing 13.

Ring portion 15 extends radially outward from hub 14 and has a locking device fastened thereto. Locking device 16 cooperates with snap-in recesses provided on intermediate housing 13.

Turning knob 17 is mounted rotatably and axially displaceably on hub 14. Turning knob 17 has two axial settings, namely a pulled-out setting and the pushed-in end position shown in FIG. 1 in which it is connected by form closure with ring portion 15 of hub 14 and thus with locking device 16 so as to rotate therewith. In the pulled-out setting, on the other hand, turning knob 17 is freely rotatable. For this purpose a toothing is provided on the inside of turning knob 17, while spring elements 18 engaging in this toothing are mounted on ring portion 15 of hub 14.

In the engaged position spring elements 18 are disposed in ring groove 19 so that they engage the toothing of turning knob 17. In the disengaged position they are pulled out of ring groove 19 so that the toothing is released. Turning knob 17 is provided with an index marking. For adjusting the graticule, e.g. after mounting the telescopic sight on the weapon, one pulls it out into one setting and then adjusts the index marking to a marking fixed on the telescope. One then pushes turning knob 17 into the other setting and adjusts the telescopic sight. That is to say, the rotation of turning knob 17 and thus of spindle 11 shifts inner tube 2 until graticule 4 matches the point of impact. One has thus performed the basic adjustment, whereupon one conforms the index marking of the turning knob with the zero mark fixed on the telescope by pulling out, turning and pushing in knob 17.

Adjusting spindle 11 is designed for supplying current to light source 10 mounted on inner tube 2. For this purpose adjusting spindle 11 consists of bolt-shaped inside part 21 and sheath-shaped ring part 22 disposed around the inside part. Electric insulation 23 is provided between inside part 21 and ring part 22. Disposed around ring part 22 is outside sheath 24 which has the outside thread serving to screw adjusting spindle 11 into the inside thread of intermediate housing 13. Inside part 21, ring part 22 and outside sheath 24 are interconnected so as to rotate with one other.

Figure 3:
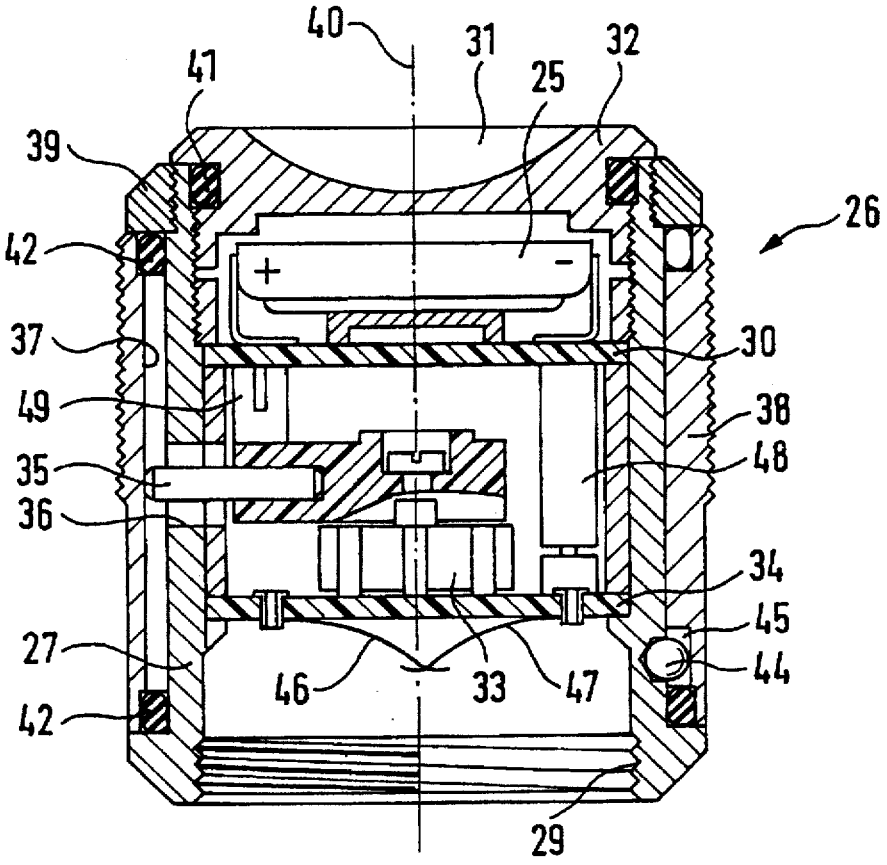
FIG. 3 shows a longitudinal section through the fixture.
Figure 4:
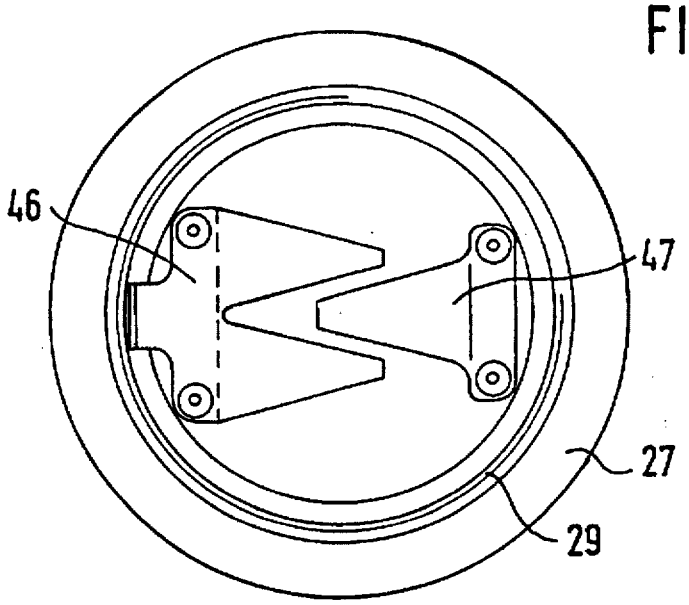
FIG. 4 shows a bottom view of the fixture.

Current source 25, e.g. a battery, for supplying current to light source 10 is disposed in fixture 26. According to FIG. 3 fixture 26 has cylindrical housing 27 with inside thread 29 serving to screw fixture 26 onto outside thread 28 on intermediate housing 13, i.e. on main tube 1.

Battery 25 is disposed on mounting plate 30 on the portion remote from inside thread 29 in housing 27. Housing 27 is closed off from the outside by cover 32 screwed into housing 27 and operable e.g. by means of coin slot 31.

Connected to battery 25 is potentiometer 33 disposed on mounting plate 34 provided on the side of fixture 26 facing inside thread 29.

Fastened to the rotating shaft of potentiometer 33 which coincides with longitudinal axis 40 of fixture 26 is arm 35 which extends through slot 36 extending around part of the periphery of housing 27 and engages in longitudinal groove 37 in turning ring 38 mounted rotatably on housing 27. Turning ring 38 is held axially by nut 39 screwed onto housing 27.

Cover 32 is sealed off from housing 27 by sealing ring 41, and turning ring 38 by sealing rings 42, 43. Ball 44 in ring groove 45 is used for rotating turning ring 38.

Fastened to the side of mounting plate 34 facing thread 29 are two contact springs 46, 47 connected to one pole of battery 25 with line 48, on the one hand, and to potentiometer 33, on the other hand, potentiometer 33 being connected to the other pole of battery 25 with line 49.

On the side of adjusting spindle 11 facing away from inner tube 2 there is printed board 51 with two contact pieces 52 and 53. On the outside of printed board 51 contact spring 47 of fixture 26 acts upon middle contact piece 52, and forked contact spring 46 upon contact piece 53 disposed concentrically therewith.

On the other side of printed board 51 contact piece 52 is acted upon by spiral spring 54 disposed in a recess in inside part 21 of adjusting spindle 11. Further, contact piece 53 is acted upon on the side of board 51 facing spindle 11 by spiral spring 55 disposed around inside part 21 and lying with its other end against ring part 22. In this way inside part 21 and ring part 22 are connected with battery 25 when fixture 26 is screwed onto outside thread 28 of intermediate housing 13 or main tube 1. Outside thread 28 is also provided for screwing on a protective cap not shown.

Light-emitting diode 10 is connected to flexible, suitably bent printed board 56 fastened to inner tube 2 on the periphery of graticule 4. Printed board 52 has two contact pieces 57, 58.

Contact piece 12 on inner tube 2 which is acted upon by inside part 21 of spindle 11 is connected via line 59 with contact piece 58 of printed board 56.

Second contact piece 57 of printed board 56 is connected with ring part 22 via plate spring 61 fastened with its end facing away from printed board 56 to the inside of intermediate housing 13. Conical coil spring 62 acts with its outer periphery upon plate spring 61, while it is fastened with its inner periphery to ring part 22. In this way light source 10 is connected to current source 25 via adjusting spindle 11.

I claim:

1. A telescopic sight having a pair of adjusting spindles disposed at an angle to each other, engaging in a thread on a main tube and acting upon an inner tube having a graticule and being movably mounted in the main tube, and a light source disposed on the inner tube in the area of the graticule and adapted to be connected to a current source for illuminating the graticule, characterized in that at least one of said adjusting spindles connects the light source to the current source, said current source being detachably fastened on said at least one of said adjusting spindles.

2. A telescopic sight having a pair of adjusting spindles disposed at an angle to each other, engaging in a thread on a main tube and acting upon an inner tube having a graticule and being movably mounted in the main tube, and a light source disposed on the inner tube in the area of the graticule and adapted to be connected to a current source for illuminating the graticule, characterized in that at least one adjusting spindle connects the light source to the current source, the adjusting spindle having an inside part and a ring part disposed around the inside part and electrically insulated from the inside part, the inside part connecting the light source with one pole of the current source, and the ring part connecting the light source with an opposite pole of the current source.

3. The telescopic sight of claim 2, characterized in that the ring part has a spiral spring disposed around the inside part disposed for connection to the current source.

4. The telescopic sight of claim 2 or 3, characterized in that the inside part acts upon a contact piece on the inner tube.

5. The telescopic sight of claim 1 or 2, characterized in that the light source is connected to contact pieces on the inner tube in the area of the graticule.

6. The telescopic sight of claim 5, characterized in that the contact pieces are provided on a printed board.

7. The telescopic sight of claim 6, characterized in that a first said contact piece is connected with the ring part of the adjusting spindle via a spiral spring.

8. The telescopic sight of claim 7, characterized in that a contact spring has a first end engaged upon a contact piece of the printed board and a second, opposite end fastened to the main tube, the spiral spring acting upon the contact spring.

9. The telescopic sight of claim 3, characterized in that the current source is located on a fixture, the fixture being adapted to be detachably fastened to the main tube to form a contact of one pole of the current source with the ring part of the adjusting spindle, and to form a contact of the other pole with the inside part of the adjusting spindle.

10. The telescopic sight of claim 9, characterized in that a side of the adjusting spindle facing away from the inner tube defines two contact pieces to which the inside part and the ring part of the adjusting spindle are connected, respectively, and to which one or the other pole of the current source is adapted to be connected.

11. The telescopic sight of claim 3 or 10, characterized in that the ring part of the adjusting spindle is connected to one contact piece with the spiral spring.

12. The telescopic sight of claim 10, characterized in that both contact pieces are provided on a printed board.

13. The telescopic sight of claim 9, characterized in that the main tube defines a further thread for detachably fastening the fixture around the thread in which the adjusting spindle engages onto which the fixture is adapted to be screwed.

14. The telescopic sight of claim 13, characterized in that the further thread forms a thread for screwing on a protective cap for the adjusting spindle.

15. The telescopic sight of claim 9, characterized in that the two contact pieces are disposed concentrically with each other on a side of the adjusting spindle facing away from the inner tube, and the fixture has contact springs connected with one and the other pole of the current source for contact with one and the other contact piece.

16. The telescopic sight of claim 9, characterized in that a potentiometer is disposed in the fixture.

17. The telescopic sight of claim 16, characterized in that a turning ring is provided on the fixture for operating the potentiometer.

18. The telescopic sight of claim 1 or 2, characterized in that the light source is formed by a light-emitting diode.

* * * * *